United States Patent [19]

Basch

[11] Patent Number: 4,561,763

[45] Date of Patent: Dec. 31, 1985

[54] DRUM SUPPORT APPARATUS

[75] Inventor: Duane C. Basch, Webster, N.Y.

[73] Assignee: Xerox Corporation, Stamford, Conn.

[21] Appl. No.: 637,654

[22] Filed: Aug. 3, 1984

[51] Int. Cl.[4] ..... G03G 15/00

[52] U.S. Cl. ..... 355/3 DR; 355/3 R; 29/123; 29/126

[58] Field of Search ..... 355/3 DR, 3 R, 14 R; 403/24, 88, 83; 29/123, 126

[56] References Cited

U.S. PATENT DOCUMENTS

| | | | |
|---|---|---|---|
| 2,465,571 | 3/1949 | Boninchi | 58/90 |
| 2,918,867 | 12/1959 | Killary et al. | 101/375 |
| 3,900,258 | 8/1975 | Hoppner et al. | 355/51 |
| 3,994,053 | 11/1976 | Hunt | 29/123 |
| 4,040,157 | 8/1977 | Shanly | 29/123 |
| 4,105,345 | 8/1978 | Van Wagner | 403/24 |
| 4,120,576 | 10/1978 | Babish | 355/3 DR |
| 4,134,669 | 1/1979 | Reitner | 355/3 DR |
| 4,326,793 | 4/1982 | Buholtz | 355/3 DR |
| 4,345,834 | 8/1982 | Kimura et al. | 355/3 DR X |
| 4,376,254 | 3/1983 | Hellmann | 310/235 |

FOREIGN PATENT DOCUMENTS

| | | |
|---|---|---|
| 618510 | 4/1961 | Canada . |
| 56185574 | 5/1983 | Japan . |
| 56185679 | 5/1983 | Japan . |
| 56185578 | 5/1983 | Japan . |
| 56185681 | 5/1983 | Japan . |

OTHER PUBLICATIONS

Xerox Disclosure Journal, vol. 2, No. 1.

*Primary Examiner*—A. C. Prescott

[57] ABSTRACT

A drum supporting hub having a tapered pot-like hub configuration comprising a bottom section and a rim, the rim comprising a plurality of circumferentially spaced resilient fingers extending at a slight incline outwardly from the axis of the pot-like hub away from the bottom section, at least three of the fingers having lips at the ends of the fingers, the lips projecting away from the axis for engagement with an end of a cylindrical drum upon insertion of the pot-like hub into the drum, the rim other than the lips having an outside diameter slightly larger than the outside diameter of the bottom. The drum supporting hub is employed in a drum assembly comprising the hub, a cylindrical drum having a circular cross-section and a shaft positioned along the axis of the drum.

18 Claims, 2 Drawing Figures

DRUM SUPPORT APPARATUS

BACKGROUND OF THE INVENTION

This invention relates in general to drum support apparatus and more specifically to a drum supporting hub and a drum assembly including the hub.

It is customary in the art of electrophotography to form an electrostatic latent image on an electrophotographic imaging member comprising an electrically conductive backing such as, for example, a metallic or metal-coated cylindrical substrate having an inorganic photoconductive insulating layer applied thereto. Typical electrophotographic imaging members comprise, for example, an aluminum cylinder having a thin layer of vitreous selenium thereon. Such members are characterized by being capable of accepting and retaining a suitable uniform electrostatic charge in the dark and of quickly and selectively dissipating a substantial part of the charge when exposed to a light pattern.

As more advanced, higher speed electrophotographic copiers, duplicators, and printers are developed, stringent requirements have been placed on these complex, highly sophisticated imaging systems including long operating life with minimum maintance requirements. For example, the supporting substrate for electrophotographic imaging members must meet precise tolerance standards and adhere well to photoconductive insulating layers applied thereto. Generally, the aluminum drums utilized as supporting substrate material for rigid drum-shaped supporting substrates are relatively expensive and often require replacement due to wear prior to the need to replace the photoconductive insulating layer. For example, rapid wear, sometimes referred to as "ring gouge", is caused by spacing shoes riding on the surface of the ends of aluminum drums. Moreover, lathing and polishing of aluminum drums are necessary prerequisites to achieving a uniform surface for subsequently applied photoconductive insulating layer or layers. Moreover, aluminum drums must necessarily be thick in order to achieve adequate rigidity to meet the stringent tolerance requirements of precision machines. Heavy drums require more powerful drive systems and rugged clutches to overcome high inertia characteristics.

The precise tolerance requirements of current reproduction machines mean low photoreceptor drum radial run-out. Damage to a drum during handling can deform the drum and counterbore resulting in an out-of-tolerance condition when the drum is fitted with end support hubs. A slight cock in the drum assembly can throw the shaft support bearing off center and this can be magnified by the weight of a heavy drum. Control of drum run-out is particularly important for magnetic brush development systems in which drum tolerance directly affects the spacing between the drum and magnetic brush roller applicators.

Various attempts to reduce drum radial run-out have been attempted for rigid drums. One approach is illustrated in U.S. Pat. No. 4,105,345 to VanWagner in which adjustable flanges are fitted into internal grooves of a rigid drum to reduce wobble. In U.S. Pat. No. 4,120,576 to Babish, support hubs having outer surfaces adapted for interface fitting with the inside surface of a drum are employed to diminish circular run-out of the drum.

In U.S. Pat. No. 4,040,157 to Shanly and U.S. Pat. No. 3,994,053 to Hunt, drum support hubs having a plurality of spaced equidistant lobes located on the outer surfaces are employed to reduce the load required to properly seat the drum against the hubs thereby decreasing the possibility of drum run-out by reducing the contact area between the hub and drum. This type of arrangement would deform a flexible drum.

In U.S. Pat. No. 2,918,867, a printing collet is described wherein the end of a cylinder is provided with a threaded recess with an intermediate shoulder at the bottom of the recess and a tapered hole extending from the shoulder toward the other end of the cylinder. An externally threaded annual driving head fitted with a longitudinally tapered sleeve having a short flange at one end, a plurality of partially longitudinally extending slots equally spaced about the periphery of the tapered portion of the sleeve and terminating short of the tapered end of the sleeve and a longitudinally extending slot extending the entire length of the sleeve, is screwed into the threaded end of the cylinder to force the sleeve between the inner surface of the tapered hole and a central axial shaft.

In laid open Japanese Patent Application No. 56-185574 to Y. Fujimaki, published May 24, 1983, a cylinder of resin or electroformed nickel coated with a photosensitive layer is fitted to a shaft by means of detachable flanges which fit on the ends of the drums. The flanges appear to comprise lips which contact the ends of the drums as well as the inner surface of the drums adjacent the ends. The detachable flanges are not self centering and require precise tolerances for both the flanges and the internal diameter of the drum.

In Japanese laid open Patent Application Ser. No. 56-185679, published May 24, 1983 to H. Tokunaga, a drum similar to the drum describd in Japanese laid open Patent Application Ser. No. 56-185574 above is disclosed. This drum is fitted with a thermostatically controlled heating element. Like the flanges of Japanese laid open Patent Application Ser. No. 56-185574, the flanges are not self centering and precise tolerances are necessary.

In laid open Japanese Patent Application Ser. No. 56-185578 to Y. Fujimaki, an electroformed drum is supported on a shaft by means of flange members such as those described above with reference to application Ser. No. 56-185574 and which additionally utilizes an annular auxillary member to support the center of the drum. Like the flanges of Japanese laid open Patent Application Ser. No. 56-185574, the flanges are not self centering and precise tolerances are required.

In laid open Japanese Patent Application Ser. No. 56-185681 to K. Omori, published May 25, 1983, the rim of the end caps of an electroformed drum are raised to contact a driven rotating member which apparently maintains the spacing between the cylinder and some type of device. In order to reduce excessive wear, the end caps need to be made of metal which will result in increased mass and higher inertia characteristics.

Thus, there is a continuing need for lightweight photoreceptors that exhibit minimum run-out and are resistant to distortion.

SUMMARY OF THE INVENTION

It is, therefore, an object of the present invention to provide an improved drum suporting hub and drum assembly which overcomes the above-noted disadvantages.

It is yet another object of the present invention to provide a drum supporting hub which reduces drum run-out.

A further object of the present invention is to reduce the effect of drum tolerances on the spacing between the drum and the developer applicators.

It is still another object of the present invention to provide a drum supporting hub which resists distortion.

It is another object of the present invention to provide a drum supporting hub which imparts self-centering characteristics to drums.

It is yet another object of the present invention to provide a drum supporting hub which is light in weight.

The foregoing and other objects of the present invention are accomplished by providing a drum supporting hub having a tapered pot-like hub configuration comprising a bottom section and a rim, the rim comprising a plurality of circumferencially spaced resilient fingers extending at a slight incline outwardly from the axis of the pot-like hub away from the bottom section, at least three of the fingers having lips at the ends of the fingers, the lips projecting away from the axis for engagement with an end of a cylindrical drum upon insertion of the pot-like hub into the drum, the rim other than the lips having an outside diameter slightly larger than the outside diameter of the bottom. The drum supporting hub is employed in a drum assembly comprising a cylindrical drum having a circular cross-section, a shaft positioned along the axis of the drum and a first drum supporting hub on the shaft at one end of the drum and a second drum supporting hub on the shaft at the other end of the drum, at least the first drum supporting hub having a self-centering, tapered pot-like hub configuration in which the rim of the pot-like hub comprises a plurality of circumferencially spaced resilient fingers extending at a slight incline outwardly from the axis of the pot-like hub away from the bottom of the pot-like hub, at least two of the fingers having lips at the ends of the fingers, the lips projecting away from the shaft for engagement with an end of the drum upon insertion of the pot-like hub into an end of the drum, the rim other than the lips having an outside diameter slightly larger than the inside diameter of the drum whereby the spaced fingers are compressed towards the shaft when the bottom of the pot-like hub is inserted into one end of the drum.

BRIEF DESCRIPTION OF THE DRAWINGS

In general, the advantages of the improved drum supporting hub and drum assembly will become apparent upon consideration of the following disclosure of the invention, particularly when taken in conjunction with the accompanying drawings wherein.

The present invention may be employed in any suitable device that requires support for a drum. However, for purposes of illustration, the invention will be described with reference to an electrophotographic imaging system. A typical electrophotographic imaging system is illustrated in U.S. Pat. No. 3,900,258 to R. F. Hoppner et al, the entire disclosure thereof incorporated herein by reference.

It is generally recognized in the art that photoreceptor drum run-out significantly affects copy quality. As each copy is produced, a bar of light scans the original document and transmits the reflected image through lenses to a rotating uniformly charged photoreceptor coated drum. The reflected light in image configuration from the original document discharges the electrical charges on the photoconductor coating to form an electrostatic latent image corresponding to the image on the original document. The drum bearing the image is rotated through a developing station containing toner particles which are attracted to and deposited on the photoconductor coating in image configuration. The resulting toner image is then electrostatically transferred to a receiving sheet. The receiving sheet bearing the toner image is then removed from the drum and transported through a fuser which fixes the toner image to the receiving sheet. Any residual toner is thereafter cleaned from the photoreceptor surface. Thus, the imaging cycle involves uniform charging, imagewise discharging, developing, transfer, and cleaning. To achieve and maintain consistently high copy quality, the radial dimensions and electrical tolerences of the electrophotographic drum and the various stations positioned around the drum must be carefully controlled in modern, sophisticated electrophotographic imaging systems. Any out-of-roundness or other imperfections in the drum surface can result in variations in copy quality or even damage to the photoconductive coating due to contact between the photoconductive coating and the various processing stations positioned around the photoconductive drum. Maintenance of precise tolerances is particularly important in electrophotographic imaging apparatus utilizing magnetic brush development in which developer material is transported through a development zone adjacent the photoconductive surface by magnetic brushes. Radial drum run-out or "wobbling" of the drum must be carefully controlled to maintain the spatial tolerances between the drum surface and the magnetic brush applicator rollers to avoid degradation of copy quality.

Figure 1:
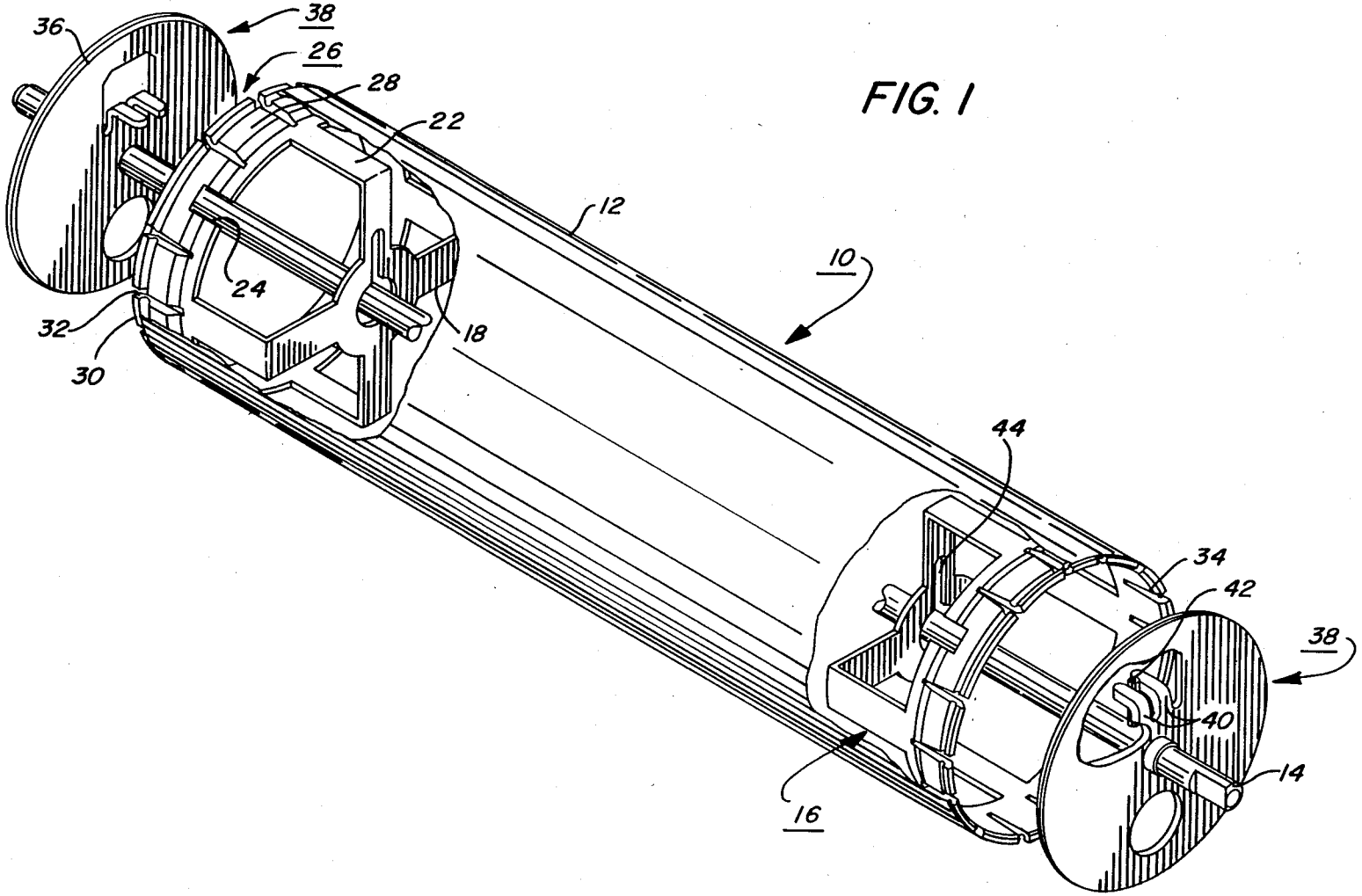
FIG. 1 is a schematic, isometric illustration of a drum supporting hub in a drum assembly of the instant invention.

Referring to FIG. 1, a cylindrical drum assembly 10 is illustrated comprising a cylindrical drum 12 having a circular cross-section supported on a shaft 14 by means of a drum supporting hub 16 may be positioned at each end of cylindrical drum 12. The drum supporting hub 16 comprises a bottom section 18 connected to an annular ring 20 by legs 22. Large open areas between the legs 22 as well as notches 24 in annular ring 20 may be optionally utilized to reduce the overall weight and quantity of material in the drum supporting hubs 16. Annular ring 20 supports a plurality of resilient fingers 26. The annular ring 20 should have an outside diameter less than the inside diameter of cylindrical drum 12 to permit insertion of the drum supporting hub 16 into cylidrical drum 12 without undue frictional interference. The resilient fingers generally extend away from annular ring 20 and away from bottom section 18 at a slight incline relative to to the axis of the drum supporting hub 16 so that, taken collectively, the resilient fingers 26 form a slightly flaired rim opening for the generally pot shaped drum supporting hub 16.

Each resilient finger 26 comprises a rim surface 28 having an arcuate cross-section (when viewed in a direction parallel to the axis of the drum) and a lip 30. Prior to insertion of drum supporting hub 16 into an end of cylindrical drum 12, an imaginary circle drawn around rim surface 28 at points furthest from bottom section 18 will have a diameter slightly larger than the inside diameter of cylindrical drum 12. Thus, when drum supporting hub 16 is inserted into an end of cylindrical drum 12, the fingers 26 are compressed toward the shaft 14 to snugly fit into the end of cylindrical drum 12. The rim surface 28 is preferably shaped so that the entire rim surface contacts and is contiguous with the inner surface of cylindrical drum 12 when the fingers 26 are compressed after insertion of the supporting hub 16 into an end of cylindrical drum 12. The large surface area of rim surface 28 in contact with the inner surface of cylindrical drum 12 forms an almost continuous supporting band which maintains the roundness of cylindrical drum 12 and provides a friction fit which prevents the supporting hub 16 from falling out of the end of cylindrical drum 12 during handling. The large surface area of rim surface 28 in contiguous contact with the inner surface of the cylindrical drum 12 also distributes the pressure from each compressed finger over a greater area of the inner surface of the cylindrical drum thereby minimizing distortion of the drum particularly in regions occupied by the slots. The rim surface 28 is normally not parallel to the inner surface of the cylindrical drum 12 prior to compression of the fingers 26. However, rim surface 28 assumes a position parallel to the inner surface of the cylindrical drum 12 after it is fully inserted into an end of cylindrical drum 12. Rim surface 28 is parallel as well as in contact with the inner surface of drum 12. This results in a contact ring or contact band which may be completely around (minus the area corresponding to the slots) the inner periphery of the the cylindrical drum 12. The width of rim surface 28 depends on the the resiliency of the cylindrical drum 12. Thus, line contact is adequate for a stiff, thick drum. Flexible drums require a contact ring contact or contact band of sufficient width to prevent distortion at the end of the drum and to resist drum flexing during use. For example, a contact ring or band ½ inch (1.27 centimeters) wide provides excellent support for thin electroformed nickel drums having a thickness of about 152 micrometers, a diameter of about 8.35 centimeters and a length of about 40 centimeters.

Lip 30 extends radially outward away from shaft 14 to function as a stop which abuts against the end of cylindrical drum 12 for accurate positioning of drum supporting hub 16 in cylindrical drum 12. Preferably, the height of lip 30 is flush with the outer surface of cylindrical drum 12 when the drum supporting hub 16 is fully inserted into cylindrical drum 12. This flush surface permits cams, seals or other mechanical means in an electrophotographic imaging apparatus to ride slightly off the edge of cylindrical drum 12 without interference by lip 30. Although lip 30 may be omitted from some of the resilient fingers, e.g. alternate fingers, a lip should be on at least 3 substantially evenly spaced apart around the circumference of the drum supporting hub 16 and, more preferably, be on every resilient finger for greater drum assembly rigidity and for optimum self centering when the drum assembly is mounted in an imaging device.

The drum supporting hub 16 should comprise at least 3 resilient fingers to maintain the cylindrical shape of cylindrical drum 12. Generally, the number of fingers desired depends to some extent upon the thickness and flexibility of cylindrical drum 12 and the resiliency of each finger. Thus, with a thick, more rigid, cylindrical drum 12, fewer fingers are necessary to maintain roundness. However, fewer fingers result in an increased potential for out-of-roundness to occur due to a decreased capability for maintaining a true radial arc corresponding to the internal perimeter of the cylinder. Generally, for any given finger thickness, an increase in the number of resilient fingers 26 also reduces the degree of friction fit of drum supporting hub 16 in the end of cylindrical drum 12. The stiffness of the resilient finger 26 may be altered by appropriate selection of materials and finger length, width, and thickness. Depending on the stiffness of resilient fingers 26 and the flexibility of cylindrical drum 12, the width of the fingers may vary one from each other as illustrated, for example, in FIG. 1. However, the variations should not be so great as to distort the roundness of the cylindrical drum 12. Similarly, the width of slot 32 between the resilient fingers 26 should be sufficiently small to avoid distortion of cylindrical drum 12. If the slot is unduly wide, a depression can form on the outer surface of the cylindrical drum 12 in the region above the slot. Similarly, the slot 32 should be sufficiently wide to permit adequate compression of the resilient fingers 26 during insertion of the supporting hub 16 into the end of cylindrical drum 12. Although the slots 32 may be of minmimal width so that the sides of adjacent resilient fingers 26 contact each other when compressed during insertion into an end of cylindrical drum 12, slightly wider slots are acceptable so long as significant distortion of the outer surface of the cylindrical drum 12 is avoided. A slot width of about 0.05 inches (1.27 millimeters) is a typical example of a slot width that provides acceptable support for an electroformed nickel drum and which can also be readily injection molded. Although not shown in FIG. 1, the slot length may, if desired, extend to or even partially into the bottom of the supporting hub. The slots should at least extend from the end or near the end of each finger to a point sufficiently beyond the rim surface 28 to allow the rim surface 28 to assume a position parallel to and in contact with the inner surface of the cylindrical drum 12 after the fingers 26 are compressed and fully inserted into an end of cylindrical drum 12 thereby providing a firm, circular, shape retaining support for the inner surface of cylindrical drum 12. Adjustment of the slot length also assists in achieving an adequate friction fit which prevents the supporting hub 16 from falling out of the lower end of cylindrical drum 12 when the drum axis is positioned vertically. Slot 32 may be of any suitable shape. For example, the slots may have parallel sides or a taper to facilitate removal from mold. The drum supporting hub 16 should contain at least 3 slots 32 to maintain the cylindrical shape of cylindrical drum 12. It should be noted that 3 slots 32 will inherently form 3 resilient fingers 26.

The inner tips of resilient fingers 26 are provided with a beveled fingertip surface 34. The beveled fingertip surface 34 mates with beveled end plate surface 36 of end plate 38. The beveled fingertip surfaces 34 collectively form a counterbore which allows self centering of the cylindrical drum about shaft 14 when the beveled end plate surface 36 of end plate 38 is pressed against and seated on the beveled fingertip surface 34 of drum supporting hub 16. The angle of bevel is preferably about 45° to the axis of the cylindrical drum when the hub is fully inserted into an end of the drum. However other larger or smaller angles deviating by as much as about 20° from about 45° may be employed if desired.

End plate 38 is also provided with a bifurcate member 40 which fits around pin 42 which in turn is secured to shaft 14. Since end plates 38 are pressed against drum supporting hub 16 by suitable means (not shown) to secure a friction fit between the beveled finger surface 34 and the beveled end plate surface 36, rotation of shaft 14 results in transmission of the rotational force through pin 42 to bifurcate member 40 to end plate 38 to drum supporting hub 16 and finally to cylindrical drum 14. Any suitable conventional means (not shown) may be employed to seat the end plates 38 against the drum supporting hubs 16. Typical seating means include tie rods as illustrated, for example, in U.S. Pat. No. 3,994,053 to Hunt and threaded shafts such as illustrated in U.S. Pat. No. 4,120,576 to Babish, the entire disclosures of these patents being incorporated herein by reference.

The cylindrical drum 12 and drum supporting hub 16 may comprise any suitable organic or inorganic material. Typical organic materials include polyester resins, polypropylene resins, epoxy resins, polycarbonate resins, polystyrene resins and the like. Typical inorganic materials include metals and alloys thereof such as aluminum, nickel, brass, and the like. The cylindrical drum 12 and drum supporting hub may comprise a homogeneous composition or a composite composition and may be electrically conductive or electrically insulating. Moreover, the cylindrical drum 12 and drum supporting hub 16 may be rendered electrically conductive by fabrication of the hub with metals or synthetic plastics containing dispersed conductive particles such as metal flakes or carbon; or coated with an electrically conductive coating such as carbon black dispersed in a resin or vacuum deposited metals such as aluminum. The cylindrical drum 12, drum supporting hub 16 and end plate 38 illustrated in FIG. 1 are all electrically conductive to permit electrical grounding of the drum through the shaft 14.

The bottom section 18 of drum supporting hub 16 is provided with a key slot 44 to allow insertion of drum supporting hub 16 past pin 42. Obviously, any other suitable means may be substituted for key slot 44 and pin 42 for securing end plate 38 to shaft 14. Typical alternative means include, for example, hexagonal or square shafts with correspondingly shaped openings in the end plates 38 which mate with periphery of the shafts.

Figure 2:
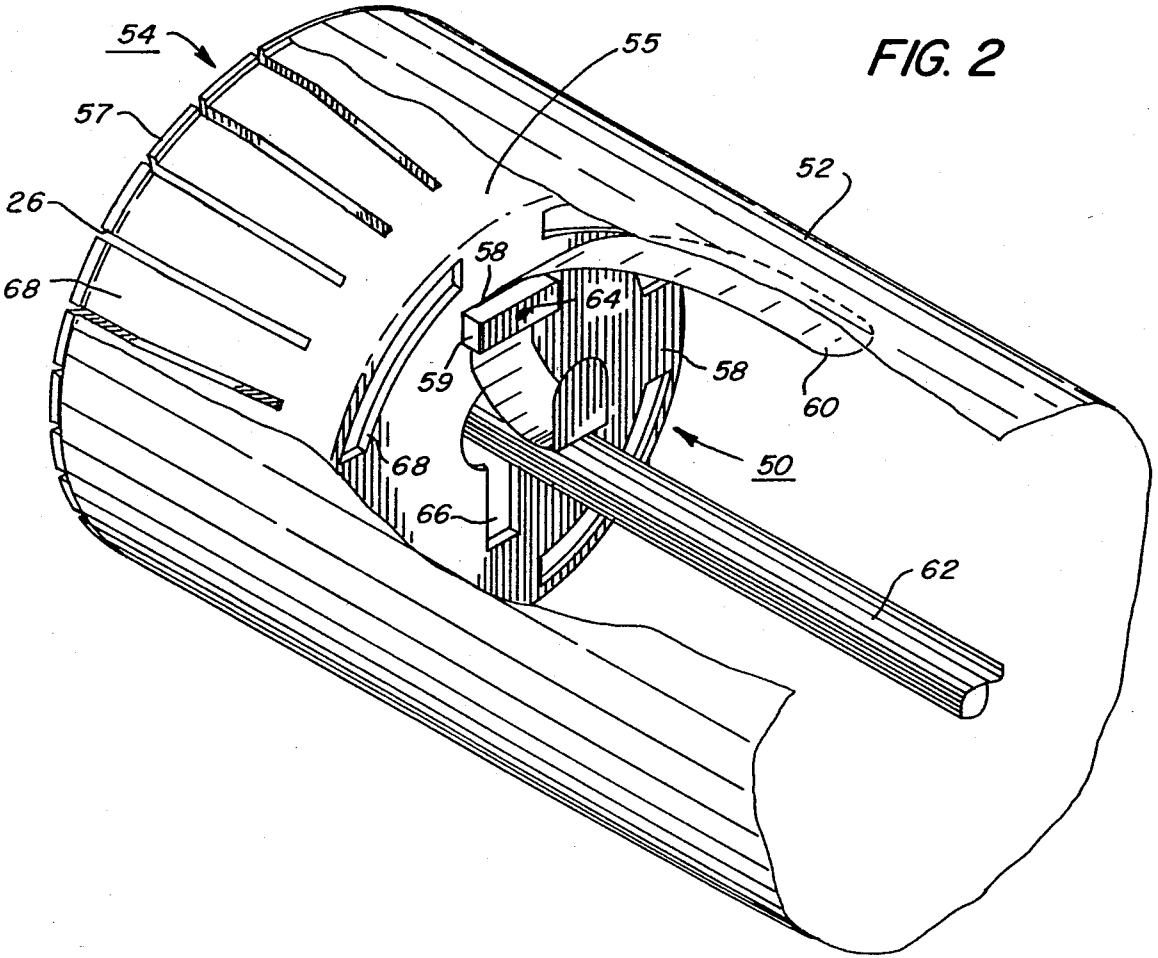
FIG. 2 is a partial, schematic, isometric illustration of a second embodiment of the drum supporting hub in a drum assembly of the instant invention.

Another embodiment of the present invention is illustrated in FIG. 2. Unlike the electrically conductive drum supporting hub 16 illustrated in FIG. 1, the drum supporting hub 50 shown fully inserted into an end of cylindrical drum 52 is electrically insulating. Moreover, the resilient fingers 54 are somewhat longer in drum supporting hub 50 than resilient fingers 26 of drum supporting hub 16.

The drum supporting hub 50 should also comprise at least 4 resilient fingers 54 to maintain the cylindrical shape of cylindrical drum 52. The characteristics of the drum supporting hub 50, resilient fingers 54 and annular ring 55 are essentially the same as those previously described with reference to supporting hub 16, resilient fingers 26 and annular ring 20 above. However, the legs 22 of drum supporting hub 16 have been eliminated in drum supporting hub 50. Although the slots 5 in drum supporting hub 50 are longer than the slots 32 in drum supporting hub 16, the overall characteristics of the width of slot 56 between the resilient fingers 54 are basically the same as those previously described with reference to slot 32 above. The inner tips of resilient fingers 54 are also provided with a beveled fingertip surface (not shown) which perform the same functions as beveled fingertip surface 34 described previously. Similarly, lips 57 perform the same functions as lips 30.

For purposes of illustration, the cylindrical drum 52 illustrated in FIG. 2 and the drum supporting hub 54 are electrically insulating. The bottom section 58 of drum supporting hub 50 is provided with a projection 59 containing slot 58 on one side and a companion slot (not visible) on the other side of projection 59 adapted to receive a metal shim 60. One end of shim 60 rides on shaft 62 and the other end of shim 60 rides on the inner conductive surface of cylindrical drum 52. Shim 60 is secured to projection 59 by means of a fastener 64. The fastener 64 may comprise any conventional fastening device such as a rivet, screw, and the like. This arrangement permits electrical grounding of the cylindrical drum 52 through an electrically conductive end plate (not shown) and shaft 62. A key slot 66 is provided for clearance if a pin (not shown) is secured to the outboard end of shaft 62.

The outer surface of drum supporting hub 50 as it extends from bottom section 58 to lip 57 is tapered or flared away from shaft 62. This taper facilitates removal of the drum supporting hub from molds, reduces the amount of material required to form the drum supporting hub and permits stacking of the drum supporting hubs during shipment and storage. Apertures 68 may be formed in section 56 to further reduce material and weight. Although, the drum assemblies illustrated in the drawings show identical drum supporting hubs at each end of the drum, the drum supporting hubs need not be identical.

Although the drum supporting hub of this invention may be employed with relatively thick cylindrical drums, they are particularly suitable for thin electroformed flexible drums. Moreover, the flexible finger arrangement is more forgiving for variations in tolerance of the inside diameter of photoreceptor drums. Generally, the drums should have a thickness sufficient to prevent distortion in the slotted regions of the drum supporting hub. The thickness of the drums should also be sufficient to support the drum shape over the length of the drum whereby the outer surface of the drum remains parallel to the axis of the shaft. Therefore, as length and diameter increase, the thickness of the drum should be increased to maintain sufficient rigidity of the assembly. Excellent cylindrical drum roundness support has been achieved, for example, with drum assemblies comprising a polystyrene drum supporting hub having 16 uniformly spaced flexible fingers, each finger having a length of about 1.8 centimeters and a thickness of about 3.25 micrometers, and a slot width prior to compression of about 1.37 millimeters in a thin cylindrical nickel drum having a thickness of about 152 micrometers and an outside diameter of about 8.3 centimeters for supporting a nickel drum having a thickness of at least about 127 micrometers, a diameter of about 8.35 centimeters and lengths of about 33 centimeters, 40 centimeters, and 42 centimeters. Tests of several of these drum assemblies involving rotation of the drums with a measuring probe riding against the surface of the drums resulted in the radial distance during drum rotation to consistently fall within the tolerance range of between about 0.001 and about 0.002 inch (25.4 and about 50.8 micrometers). Satisfactory results may be achieved in many precision electrophotgraphic imaging systems when the radial distance tolerance range is as great as between about 0.002 and about 0.004 inch (50.8 and about 102 micrometers).

The invention has been described in detail with particular reference to preferred embodiments thereof but it will be understood that variations and modifications can be effected within the spirit and scope of the invention as described herein above and as defined in the appended claims.

I claim:

1. A drum assembly comprising a cylindrical drum having a circular cross-section, a shaft positioned along the axis of said drum and a first drum supporting hub on said shaft at one end of said drum and a second drum supporting hub on said shaft at the other end of said drum, at least said first drum supporting hub having a self-centering, tapered pot-like hub configuration in which the rim of the pot-like hub comprises a plurality of circumferentially spaced resilient fingers extending at a slight incline outwardly from the axis of said pot-like hub away from the bottom of the pot-like hub, said fingers having lips at the ends of said fingers, said lips projecting away from said shaft for engagement with an end of said drum upon insertion of said pot-like hub into an end of said drum, said rim other than said lips having an outside diameter slightly larger than the inside diameter of said drum whereby said spaced fingers are compressed towards said shaft when said bottom of said pot-like hub is inserted into one end of said drum.

2. A drum assembly according to claim 1 wherein said pot-like hub includes means for electrically grounding said cylindrical drum to said shaft.

3. A drum assembly according to claim 2 wherein said means for electrically grounding said cylindrical drum to said shaft comprises a conductive outer surface on said pot-like hub.

4. A drum assembly according to claim 1 wherein said cylindrical drum comprises a thin flexible electroformed metal sleeve.

5. A drum assembly according to claim 3 wherein said pot-like hub comprises at least three circumferentially spaced fingers to exert a substantially uniform force against said cylindrical drum thereby maintaining said circular cross section of said thin flexible metal sleeve.

6. A drum assembly according to claim 4 wherein said pot-like hub comprises a sufficient number of circumferentially spaced fingers to exert a substantially uniform force against the inner surface of said cylindrical drum thereby maintaining said circular cross section of said thin flexible metal sleeve.

7. A drum assembly according to claim 1 wherein said cylindrical drum comprises a thin flexible metal sleeve having at least a portion of its outer surface coated with at least one photoconductive insulating layer.

8. A drum assembly according to claim 1 wherein said cylindrical drum comprises a rigid metal sleeve.

9. A drum assembly according to claim 1 including a key slot in said bottom of said pot-like hub.

10. A drum assembly according to claim 1 wherein said pot-like hub comprises an annular ring in which one edge of said ring supports said circumferentially spaced fingers and in which the opposite edge supports a plurality of legs which join to form said bottom.

11. A drum assembly according to claim 1 wherein each of said circumferentially spaced resilient fingers are spaced from adjacent fingers by a narrow slot.

12. A drum assembly according to claim 1 wherein the inside tip opposite said lip of of said circumferentially spaced resilient fingers is beveled to form a counterbore surface.

13. A drum supporting hub having a tapered pot-like hub configuration comprising a bottom section and a rim, said rim comprising a plurality of circumferentially spaced resilient fingers extending at a slight incline outwardly from the axis of said pot-like hub away from said bottom section, at least three of said fingers having lips at the ends of said fingers, said lips projecting away from said axis for engagement with an end of a cylindrical drum upon insertion of said pot-like hub into said drum, said rim other than said lips having an outside diameter slightly larger than the outside diameter of said bottom section.

14. A drum supporting hub according to claim 12 wherein each of said circumferentially spaced resilient fingers are spaced from adjacent fingers by a narrow slot.

15. A drum supporting hub according to claim 12 wherein the inside tips opposite said lips of each of said circumferentially spaced resilient fingers is beveled to collectively form a counterbore surface.

16. A drum supporting hub according to claim 12 wherein said pot-like hub comprises an annular ring having one edge which supports said circumferentially spaced fingers and an opposite edge which supports a plurality of legs which join to form said bottom section.

17. A drum supporting hub according to claim 12 wherein said circumferentially spaced fingers comprise an outer arcuate rim surface adjacent to said ends of said fingers which are capable of contiguous supporting contact with the inner surface of a cylidrical drum when said drum supporting hub is inserted into an end of said cylindrical drum.

18. A cylindrical drum assembly according to claim 12 including a key slot in said bottom section of said pot-like hub.

* * * * *